US011319101B2

(12) United States Patent
Vartanians

(10) Patent No.: US 11,319,101 B2
(45) Date of Patent: May 3, 2022

(54) JAM DETECTING DEVICE, A METHOD FOR DETECTING DEFECTIVE PACKAGES IN A FILLING MACHINE, A FOLDING UNIT FOR PRODUCING PACKAGES OF POURABLE FOOD PRODUCTS IN A FILLING MACHINE, AND A FILLING MACHINE

(71) Applicant: Tetra Laval Holdings & Finance S.A., Pully (CH)

(72) Inventor: Vartan Vartanians, Modena (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 0 days.

(21) Appl. No.: 15/774,047

(22) PCT Filed: Jan. 13, 2017

(86) PCT No.: PCT/EP2017/050640
§ 371 (c)(1),
(2) Date: May 7, 2018

(87) PCT Pub. No.: WO2017/133878
PCT Pub. Date: Aug. 10, 2017

(65) Prior Publication Data

US 2019/0152639 A1 May 23, 2019

(30) Foreign Application Priority Data

Feb. 2, 2016 (EP) ..... 16153745

(51) Int. Cl.
*B65B 57/10* (2006.01)
*B65B 57/04* (2006.01)
(Continued)

(52) U.S. Cl.
CPC ..... *B65B 57/04* (2013.01); *B65B 3/025* (2013.01); *B65B 57/10* (2013.01); *B65B 61/24* (2013.01); *B65B 61/28* (2013.01)

(58) Field of Classification Search
CPC ..... B65B 3/025; B65B 57/10; B65B 57/02; B65G 47/841; B65G 47/8861; B65G 15/58
(Continued)

(56) References Cited

U.S. PATENT DOCUMENTS 2,762,497 A 9/1956 Howard
4,330,061 A * 5/1982 Rudszinat ..... B07C 5/362 209/3.1
(Continued)

FOREIGN PATENT DOCUMENTS

CN 201597789 U 10/2010
CN 102991738 A 3/2013
(Continued)

OTHER PUBLICATIONS

International Search Report from corresponding PCT Application No. PCT/EP2017/050640 dated Apr. 10, 2017 (2 pages).
(Continued)

*Primary Examiner* — Chelsea E Stinson
(74) *Attorney, Agent, or Firm* — Finnegan, Henderson, Farabow, Garrett & Dunner, LLP

(57) ABSTRACT

The invention relates to a jam detecting device (10) for detecting defective packages in a filling machine. The jam detecting device (10) comprises a movable element 5 (12), and a sensor (13) connected to the movable element (12). The jam detecting device (10) is adapted to be positioned in the filling machine such that any defective package will mechanically raise the movable element (12) when passing the same and thereby trigger the sensor (13). The invention
(Continued)

also relates to a method for detecting defective packages in a filling machine, and a folding unit (1) and a filling machine for producing packages (2) of pourable food products from sealed packs (3).

2 Claims, 4 Drawing Sheets

(51) Int. Cl.

| | |
|---|---|
| ***B65B 61/28*** | (2006.01) |
| ***B65B 3/02*** | (2006.01) |
| ***B65B 61/24*** | (2006.01) |

(58) Field of Classification Search
USPC ..... 53/467, 53; 73/12.01, 12.09; 198/419.3, 198/473.1, 484.4, 698
See application file for complete search history.

(56) References Cited

U.S. PATENT DOCUMENTS

| | | | | |
|---|---|---|---|---|
| 4,593,515 | A | 6/1986 | Margraf | |
| 4,656,815 | A * | 4/1987 | Jaton | B65B 57/10 271/119 |
| 2010/0171255 | A1* | 7/2010 | Gulbrandsen | B65H 5/26 270/52.19 |
| 2015/0344163 | A1* | 12/2015 | Santi | B65B 61/28 53/375.7 |

FOREIGN PATENT DOCUMENTS

| | | | |
|---|---|---|---|
| CN | 103708060 | A | 4/2014 |
| CN | 104781147 | A | 7/2015 |
| EP | 2 746 170 | A1 | 6/2014 |
| EP | 2 923 959 | A1 | 9/2015 |

OTHER PUBLICATIONS

Chinese Office Action cited in corresponding Chinese Application No. 201780004129.1 dated Feb. 6, 2020 (9 pgs.).

* cited by examiner

JAM DETECTING DEVICE, A METHOD FOR DETECTING DEFECTIVE PACKAGES IN A FILLING MACHINE, A FOLDING UNIT FOR PRODUCING PACKAGES OF POURABLE FOOD PRODUCTS IN A FILLING MACHINE, AND A FILLING MACHINE

CROSS-REFERENCE TO RELATED PATENT APPLICATIONS

This is a National Phase of International Application No. PCT/EP2017/050640, filed Jan. 13, 2017, which claims the benefit of European Application No. 16153745.1 filed Feb. 2, 2016. The entire contents of the above-referenced applications are expressly incorporated herein by reference.

TECHNICAL FIELD

The invention relates to a jam detecting device and a method for detecting defective packages in a filling machine. The invention is also related to a folding unit and a filling machine for producing packages of pourable food products from sealed packs.

BACKGROUND ART

As is known, many food products, such as fruit juice, pasteurized or UHT (ultra-high-temperature treated) milk, wine, tomato sauce, etc., are sold in packages made of sterilized packaging material.

A typical example of this type of package is the parallelepiped-shaped package for liquid or pourable food products known as Tetra Brik Aseptic (registered trademark), which is made by folding and sealing laminated strip packaging material.

The packaging material has a multilayer structure substantially comprising a base layer for stiffness and strength, which may comprise a layer of fibrous material, e.g. paper, or of mineral-filled polypropylene material, and a number of layers of heat-seal plastic material, e.g. polyethylene film, covering both sides of the base layer.

In the case of aseptic packages for long-storage products, such as UHT milk, the packaging material also comprises a layer of gas- and light-barrier material, e.g. aluminium foil or ethyl vinyl alcohol (EVOH), which is superimposed on a layer of heat-seal plastic material, and is in turn covered with another layer of heat-seal plastic material forming the inner face of the package eventually contacting the food product.

As is known, packages of this sort are produced on fully automatic packaging machines, on which a continuous tube is formed from the web-fed packaging material, the web of packaging material is sterilized on the packaging machine, e.g. by applying a chemical sterilizing agent, such as a hydrogen peroxide solution, which, once sterilization is completed, is removed from the surfaces of the packaging material, e.g. evaporated by heating, and the web of packaging material so sterilized is maintained in a closed, sterile environment, and is folded and sealed longitudinally to form a vertical tube.

The tube is filled continuously downwards with the sterilized or sterile-processed food product, and is sealed and then cut along equally spaced cross sections to form pillow packs, which are then fed to a folding unit to form the finished packages, e.g. substantially parallelepiped-shaped packages.

More specifically, the pillow packs substantially comprise a parallelepiped-shaped main portion, and opposite top and bottom end portions projecting laterally on opposite sides of the main portion and defining respective triangular end flaps to be folded onto the main portion.

A longitudinal sealing strip, formed when sealing the packaging material to form the vertical tube, extends along the pillow packs, and the end portions of each pillow pack have respective transverse sealing strips perpendicular to the relative longitudinal sealing strip and defining respective end tabs projecting from the top and bottom of the pack.

The end portions of each pillow pack taper towards the main portion from the respective end tabs, and are pressed towards each other by the folding unit to form flat opposite end walls of the pack, while at the same time folding the end flaps onto respective walls of the main portion.

Packaging machines of the above type are known which comprises a folding unit where pillow packs are turned into folded packages by folding means, and a transferring and up-ending unit for tipping the folded packages.

The folding unit substantially comprises a chain conveyor feeding the pillow packs along a forming path from a supply station to an output station, a fixed elongated guide member, which is positioned facing and at a distance from the chain conveyor and cooperates cyclically with each pillow pack to flatten a first end portion of the pillow pack and so fold respective tab onto such first end portion, and folding elements cooperating cyclically with each pillow pack to flatten a second end portion of the pillow pack and so fold respective tab onto such second end portion.

The transferring and up-ending unit is arranged downstream from the folding unit. The transferring and up-ending unit transfers the packages successively along a conveying path from an in-feed station to an out-feed station, and simultaneously up-ends the packages from an in-feed position, in which the packages are positioned with their axis tilted to the horizontal, into an out-feed position, in which the packages are positioned with their axis substantially vertical.

The transferring and up-ending unit receives the packages at the in-feed station from the chain conveyor of the folding unit, and feeds them to a further conveyor at the out-feed station.

More specifically, the chain conveyor supplies the unit with packages in the in-feed position, and the further conveyor withdraws the packages from the unit in the out-feed position.

The transferring and up-ending unit substantially comprises a rotary member having a number of push arms which cooperate with respective packages to remove the packages from the folding unit and push the packages along the conveying path. The transferring and up-ending unit further comprises a fixed guide extending substantially along the conveying path and cooperating with the packages to ease them from the tilted in-feed position to the out-feed position.

More specifically, the conveying path along which the packages are fed is substantially in the form of an arc of circumference, at the end of which, the packages are fed to the further conveyor.

A drawback of the known packaging machines is that it may be difficult to control the transfer of the packages from the folding unit to the transferring and up-ending unit, especially at high output rates of the packaging machines, i.e. when the packages are advanced at high speed.

If the packages carried by the chain conveyor of the folding unit are not in the right position when the push arms of the transferring and up-ending unit interact with them, the push arms are not able to remove the packages from the folding unit in the proper way. In this case, package jams may occur that lead to packaging machine stops, and so to a reduction of the packaging machine efficiency.

Another potential problem is the presence of defective packages. If a defective package is out-fed from the folding unit to the transferring and up-ending unit, there is a risk of breakage of the push arms or other parts of the unit.

SUMMARY OF THE INVENTION

It is an object of the present invention to mitigate, alleviate or eliminate one or more of the above-identified deficiencies in the art and disadvantages singly or in any combination and solve at least the above mentioned problem.

According to a first aspect, these and other objects are achieved in full, or at least in part, by a jam detecting device for detecting defective packages in a filling machine. The jam detecting device comprises a movable element and a sensor connected to the movable element. The sensor is triggered by movement of the movable element due to mechanical impact from a passing defective package. More in detail, the jam detecting device is positioned in the filling machine such that any defective package passing the movable element will mechanically raise the same and thereby trigger the sensor.

Owing to the jam detecting device, it is possible to detect any defective package in the filling machine and directly trigger the sensor which in turn may initiate an immediate stop of the filling machine, or at least a part, or unit, of the filling machine. In this way, it will also be possible to better locate the underlying problem that caused the defective package.

The jam detecting device is preferably arranged at the output station of the folding unit of the filling machine. Such an arrangement will make it possible to prevent defective packages from reaching the transferring and up-ending unit of the filling machine and thus minimize the risk of breakage of the push arms or other parts of the unit.

The jam detecting device will also to some extent give information about some of the components arranged upstream of the same in the filling machine, which may have caused the defect in the packages, such as, for example the sharpness of the knifes of the forming unit in which the packs have been formed, etc.

The jam detecting device may further comprise a shaft element arranged in connection with the movable element to ensure a free movement of the movable element. The movable element may be rotationally attached to the shaft.

The jam detecting device may further comprise an adjustment element adapted to adjust a maximum clearance between the movable element and any non-defective packages passing the same, in order to control the sensitivity of the jam detecting device.

The jam detecting device may further comprise a control unit connected to the sensor. In turn, the control unit may be adapted to stop at least a part, or unit, of the filling machine when the sensor is triggered. The sensor is preferably constituted by an optical sensor or an inductive sensor. Also, the jam detecting device may further comprise a connector through which the sensor is connected to the jam detecting device in order to facilitate replacement of the sensor.

According to a second aspect of the invention, the objects are achieved in full, or at least in part, by a folding unit for a filling machine for producing packages of pourable food products from sealed packs. The folding unit comprises a movable conveying member, and folding means arranged for folding at least one end portion of said packs, whilst the packs are conveyed by the conveying member, to obtain said packages. The conveying member carries a plurality of plates, each plate being configured to receive a pack and to deliver a package to a transferring and up-ending unit arranged downstream of the folding unit. The folding unit is characterised in that it further comprises a jam detecting device as described above.

The jam detecting device is preferably arranged at an output station of the folding unit. More specifically, the jam detecting device may be arranged downstream a top squeezer belt and upstream a top brush of the folding unit.

Furthermore, the movable element of the jam detecting device may be arranged above the uppermost plates of the conveying member in the folding unit. More specifically, the movable element of the jam detecting device may be arranged at a predetermined distance from the uppermost plates to create a clearance between the movable element and any non-defective packages passing the same.

According to a third aspect of the invention, the objects are achieved in full, or at least in part, by a filling machine for producing packages of pourable food products from sealed packs, comprising a jam detecting device as described above or a folding unit as described above.

According to a fourth aspect of the invention, the objects are achieved in full, or at least in part, by a method for controlling the operation of a filling machine for producing packages of pourable food products. The method comprises the steps of detecting any defective package by means of a sensor triggered by movement of a movable element due to mechanical impact from a passing defective package, and stopping at least a part of the filling machine based on information from the sensor.

Generally, all terms used in the claims are to be interpreted according to their ordinary meaning in the technical field, unless explicitly defined otherwise herein. All references to "a/an/the [element, device, component, means, step, etc.]" are to be interpreted openly as referring to at least one instance of the element, device, component, means, step, etc., unless explicitly stated otherwise.

BRIEF DESCRIPTION OF THE DRAWINGS

The above objects, as well as additional objects, features and advantages of the present invention, will be more fully appreciated by reference to the following illustrative and non-limiting detailed description of preferred embodiments of the present invention, when taken in conjunction with the accompanying drawings, wherein.

DETAILED DESCRIPTION OF PREFERRED EMBODIMENTS OF THE INVENTION

Figure 1:
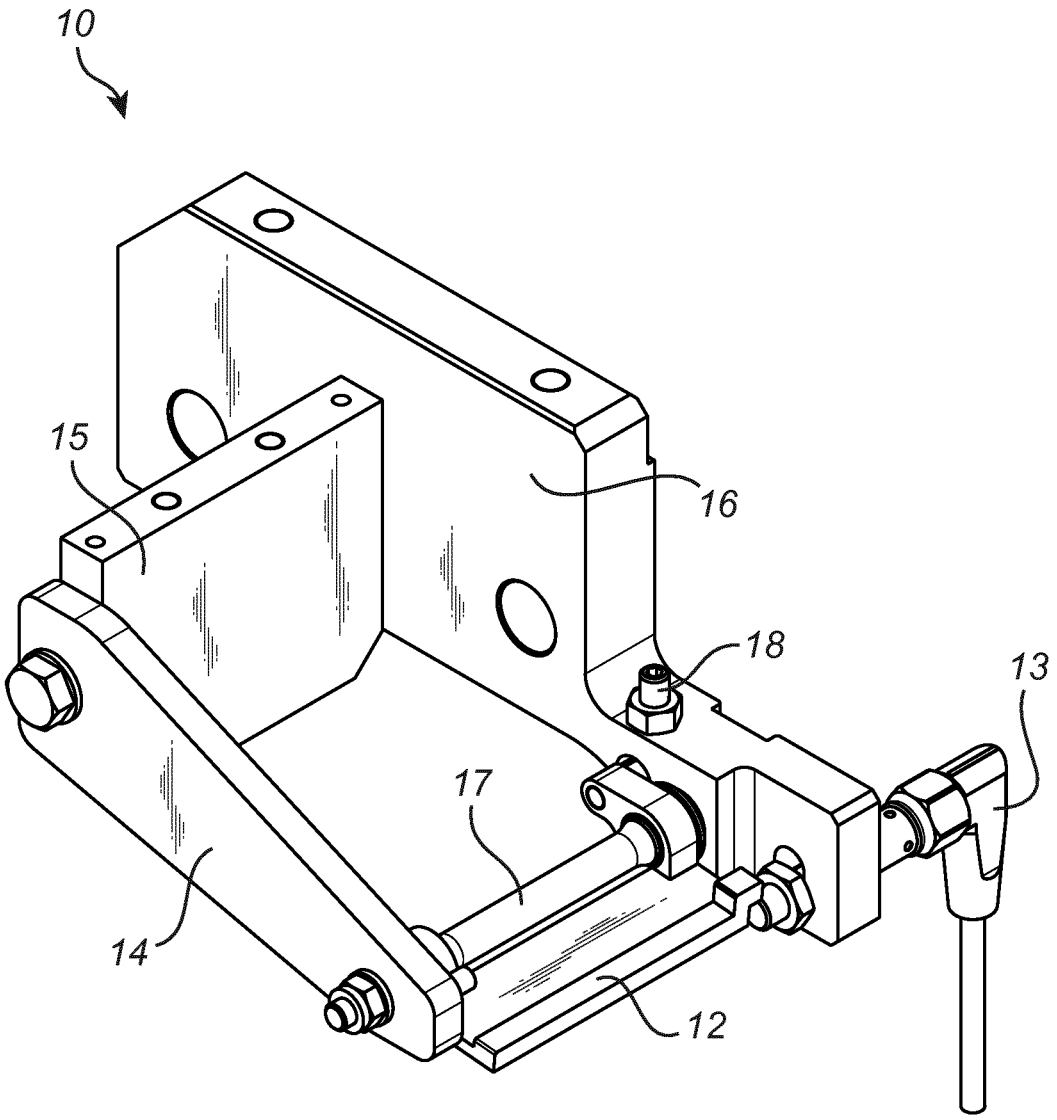
FIG. 1 is a perspective view of a jam detecting device according to one exemplary embodiment of a first aspect of the present invention.

FIG. 1 illustrates a jam detecting device 10 for detecting defective packages in a filling machine according to one exemplary embodiment of the invention. The jam detecting device 10 comprises a movable element and a sensor 13 which is connected to the movable element 12. The sensor 13 is triggered by movement of the movable element 12 due to mechanical impact from a passing defective package. The jam detecting device 10 has four main support members 14, 15, 16, 17. The support member 17 is constituted by a shaft that is provided between two of the other support members 14, 16 to ensure a free movement of the movable element 12. That is, the shaft 17 will make sure that the two support members 14, 16, between which the movable element 12 extends in its longitudinal direction, do not interfere with the rotational movement of the movable element 12 around the shaft 17. Specifically, the shaft 17 comprises two stoppers (not shown) that limit the closure between the two support members 14, 16 at a distance which is larger than the length of the movable element 12. In this specific embodiment, the movable element 12 is rotationally attached to the shaft 17.

The jam detecting device 10 further comprises an adjustment element 18 which is able to adjust a maximum clearance between movable element 12 and any non-defective packages passing the same. Specifically, the adjustment element 18 is movable in a vertical direction to engage with a portion of the movable element 12, thereby limiting its movement in the same vertical direction. In this way, the clearance between the movable element 12 and any non-defective packages passing the same can be adjusted and thus sensitivity of the jam detecting device 10 controlled.

The jam detecting device 10 further comprises a control unit (not shown) which is connected to the sensor 13. When the sensor 13 is triggered due to movement of the movable element 12, the control unit can be programmed to stop at least a part, or unit, of the filling machine.

Figure 2:
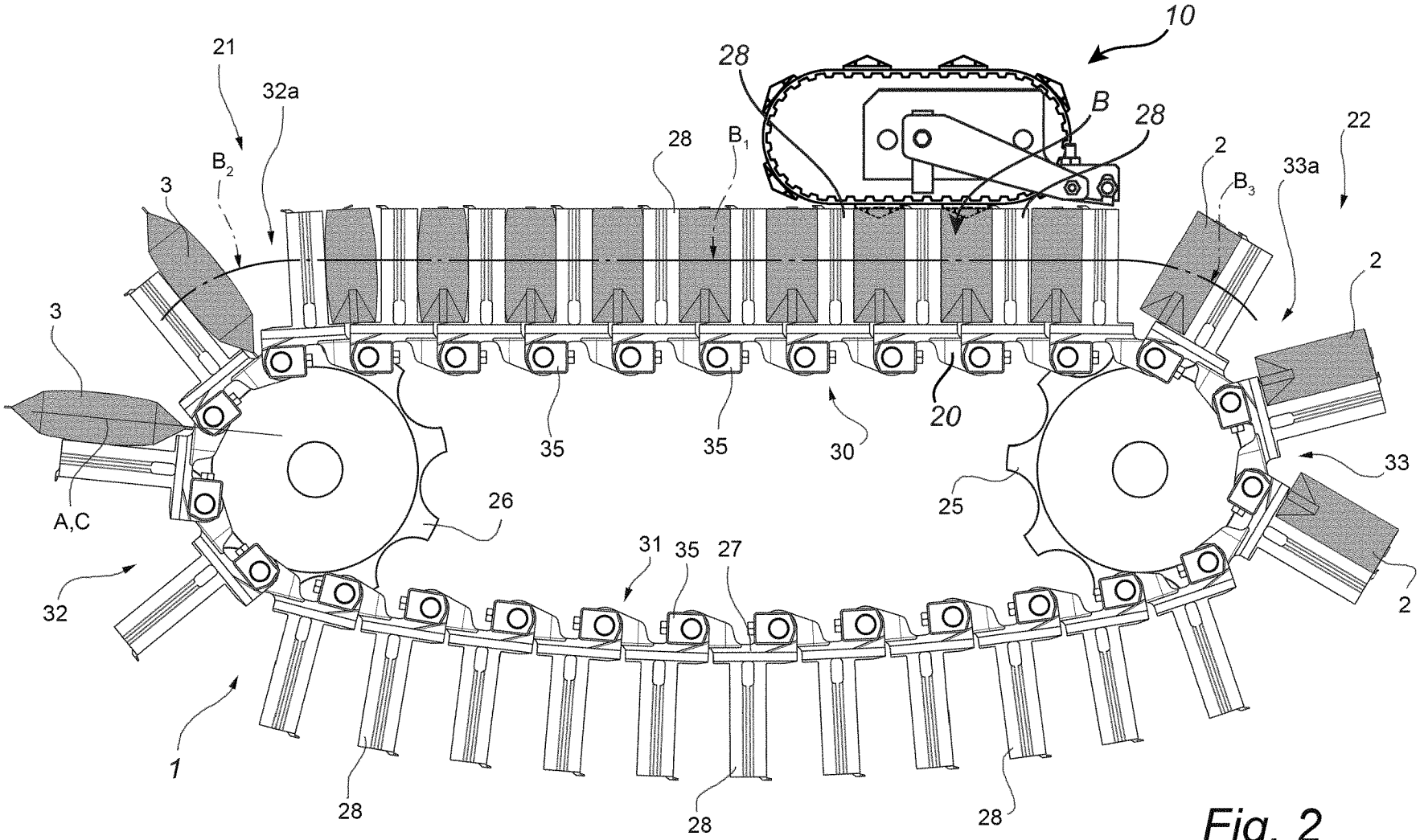
FIG. 2 is a side view of a folding unit according to one exemplary embodiment of a second aspect of the present invention.
Figure 3:
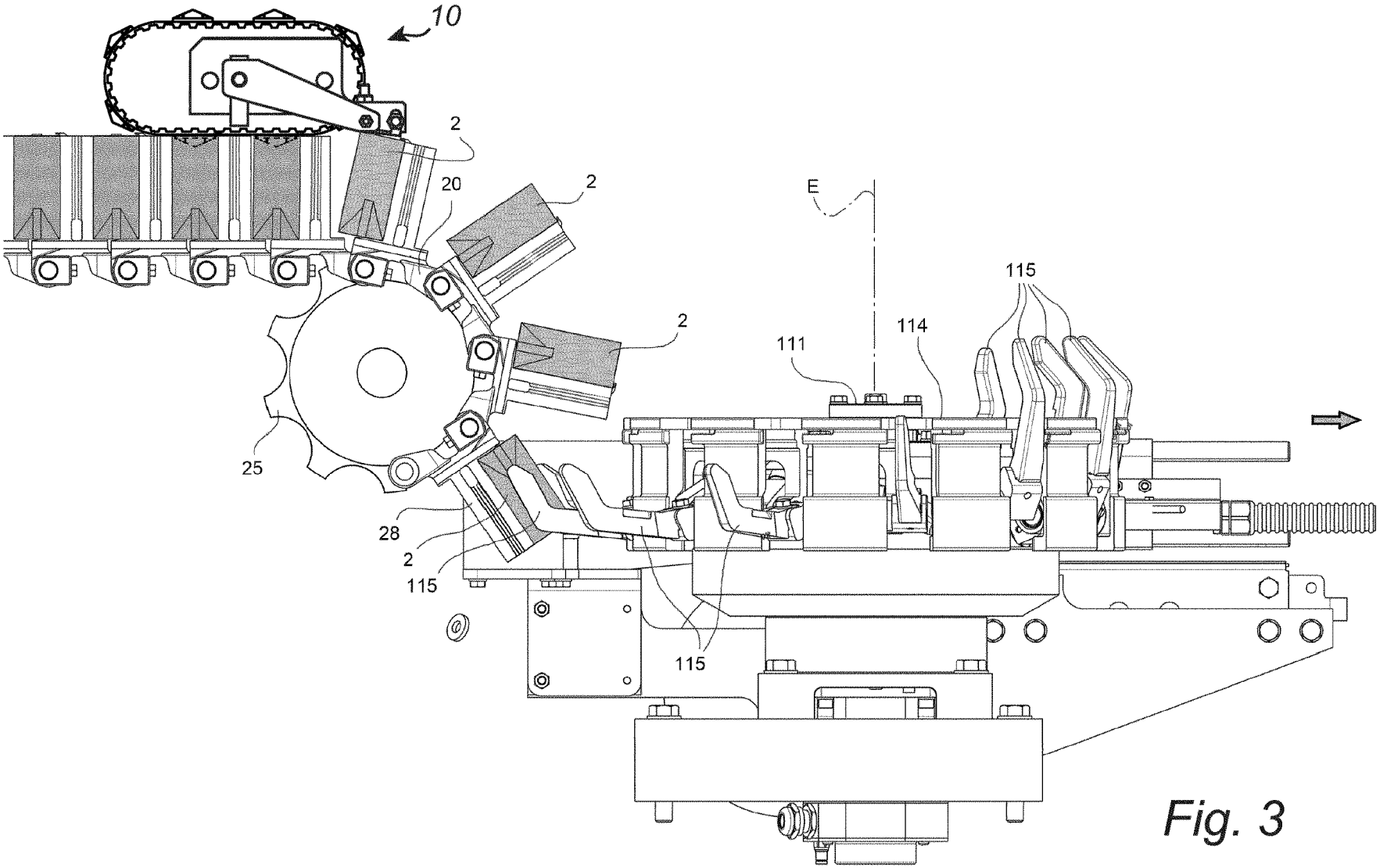
FIG. 3 is a partial side view of the folding unit and of a transferring and up-ending unit, with parts removed for clarity.
Figure 4:
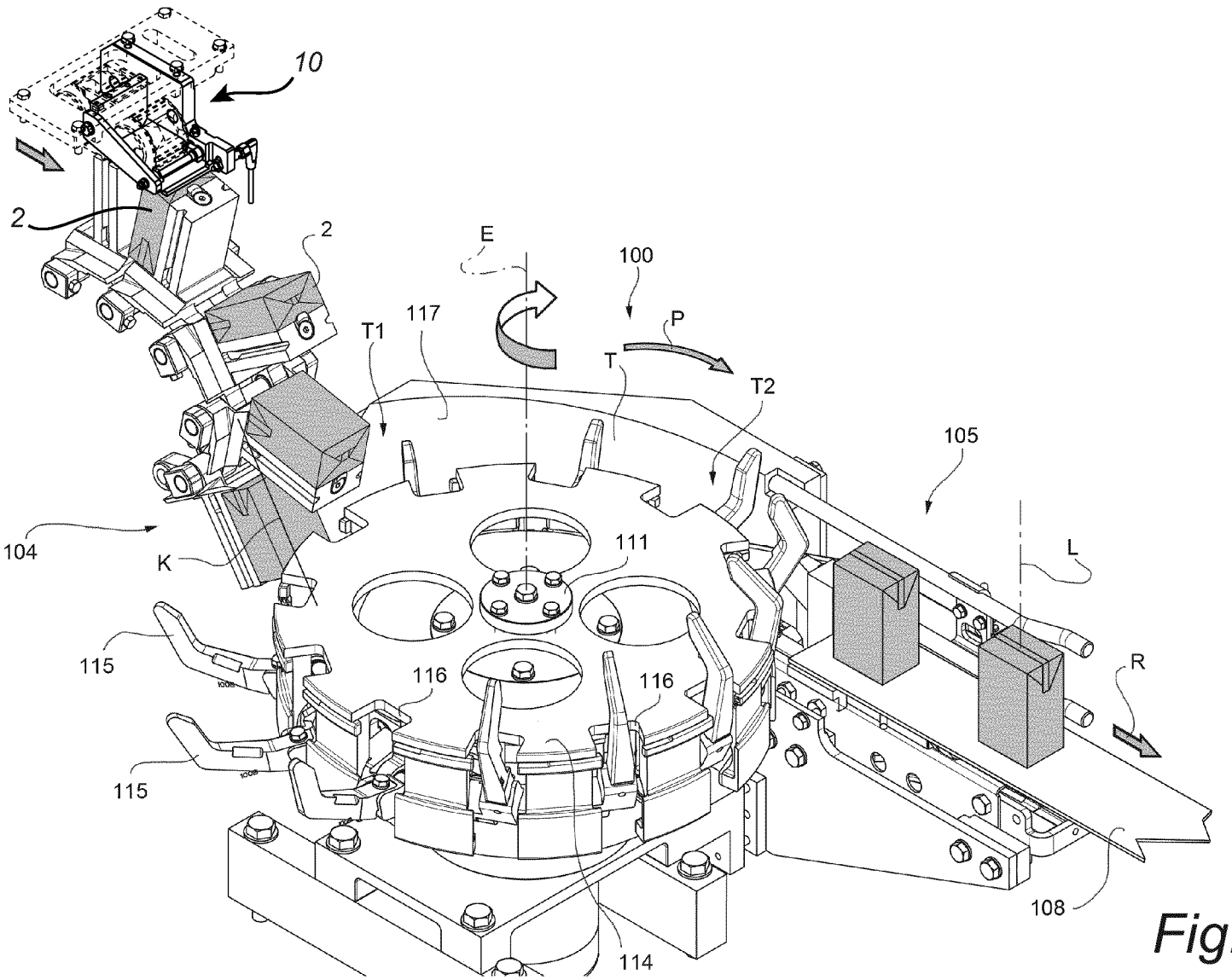
FIG. 4 is a partial perspective view of the folding unit and of the transferring and up-ending unit of FIG. 3, with parts removed for clarity.

With reference to FIGS. 2, 3 and 4, a folding unit 1 substantially comprises a conveyor 20 for feeding packs 3 continuously along a predominantly straight horizontal forming path B from a supply station 21 to an output station 22 (both shown only schematically) and folding means for folding packs 3, in particular at least one end portion of packs 3, whilst packs 3 are carried by the conveyor 20, to obtain packages 2. The folding means are known from prior art and, therefore, they are not shown and disclosed in detail. For example, the folding means may comprise a fixed elongated guide member and folding elements as explained above.

Conveyor 20 comprises at least one gear and, in the example shown, a drive gear 25 and a driven gear 26, and an articulated chain 27 looped about and meshing with gears 25, 26, and supporting a number of plates 28, for example flat rectangular plates, each of which projects from chain 27 and cooperates with and pushes a pack 3 to feed it along path B.

Chain 27 comprises a straight horizontal top branch 30, a bottom branch 31 substantially parallel to branch 30, and two curved C-shaped portions 32, 33, which are positioned with their concavities facing each other, connect branches 30 and 31, and the middle portions of which define supply station 21 and output station 22 respectively.

Path B comprises a straight main portion $B_1$ defined by branch 30 of chain 27, and two, respectively supply and output, curved end portions $B_2$, $B_3$ defined by respective top portions 32*a*, 33*a* of portions 32, 33 of chain 27 extending between corresponding stations 21, 22 and branch 30. Branch 30 and portions 32*a*, 33*a* of portions 32, 33 therefore define a conveying portion of chain 27 to convey packs 3 from station 21 to station 22, while branch 31 and the remaining portions of portions 32, 33 define a return portion of chain 27 to feed plates 28 from station 22 to station 21.

Chain 27 comprises a number of articulated links 35 defined by substantially flat rectangular bodies, from which respective plates 28 project perpendicularly.

Given the structure of conveyor 20, plates 28 are positioned vertically along portion $B_1$ of path B.

At supply station 21, each pack 3 is fed onto conveyor 20 in a feed direction C, coaxial with an axis A of pack 3.

Between supply station 21 and output station 22, the jam detecting device 10 is arranged above the uppermost plates 28 of the conveyor 20. In this way, the movable element 12 of the jam detecting device 10 is arranged at a predetermined distance from the uppermost plates 28 to create a clearance between the movable element 12 and any non-defective packages 2 passing the same.

With reference to FIGS. 3 and 4, number 100 indicates as a whole a transferring and up-ending unit for tipping the packages 2.

Transferring and up-ending unit 100 is known and, therefore, it will be described only to the extent that is necessary for the understanding of the invention.

Transferring and up-ending unit 100 feeds a succession of packages 2 continuously along a path P extending from an in-feed station 104 to an out-feed station 105, and simultaneously up-ends packages 2 continuously from an in-feed position, in which they are positioned with axes A oriented in a direction K, into an out-feed position, in which they are positioned with respective axes A oriented in a direction L crosswise to direction K. With reference to the embodiment shown, direction K is sloped relative to a horizontal plane and direction L is vertical.

Transferring and up-ending unit 100 receives packages 2 continuously and successively at in-feed station 104 from conveyor 20, and feeds them, in the out-feed position, to an output conveyor 108 at out-feed station 105. Output conveyor 108 moves the packages 2 along a substantially straight path R tangent to an end portion of path P.

Transferring and up-ending unit 100 comprises a number of push arms 115 for removing respective packages from conveyor 20 at in-feed station 104 and feeding them along path P to out-feed station 105, and a guide 117 which cooperates with packages 2 along path P to up-end them from the in-feed position to the out-feed position.

Path P is arc-shaped about an axis E and extends along an angle of about 90° from in-feed station 104 to out-feed station 105.

Transferring and up-ending unit 100 also comprises a drive shaft 111 rotating continuously about axis E and powered by an electric motor of the packaging machine in known manner not shown, and a wheel 114 of axis E, fitted to shaft 111 rotatably about axis E, and supporting the push members 115, which are hinged to wheel 114.

Push arms 115 rotates together with wheel 114 around axis E and oscillate with respect to wheel 114 between a first operating position, in which they remove the packages 2 from folding unit 1, to a second operating position, in which—after delivering the packages 2 to the conveyor 108—are received into slots 116, obtained in the wheel 114.

Push arms 115 are provided at their ends opposite to the ends which interact with packages 2 with cam followers (not shown) that interact with a fixed cam (not shown), so that the fixed cam drives the push arms 115.

Guide 117 is curved, extends substantially along path P, on the outside of wheel 114, and cooperates with packages 2 to ease them from the in-feed to the out-feed position.

Furthermore, guide 117 defines a supporting and slide surface T for packages 2, which extends substantially along path P and slopes gradually from a portion T1, parallel to direction B and adjacent to in-feed station 104, to a substantially flat, vertical out-feed portion T2 parallel to direction L and adjacent to out-feed station 105.

During operation, packs 3 are fed to conveyor 20 and—as conveyor 20 carries them along path P—the folding means fold packs 3, in particular end portions thereof, so as to form packages 2.

When a package 2 reaches output station 22, i.e. the region where the folding unit 1 cooperates with the transferring and up-ending unit 100, a push arm 115 interacts with the package 2 in order to remove the package 2 from the corresponding plate 28. Subsequently, the push arm 115 delivers the package 2 to the output conveyor 108.

If a defective pack reaches the conveyor 20, or if it is damaged and becomes defective when folded into a package within the folding unit 1, the plates 28, between which it is constrained, will force the defective package to rise above the plates 28. Thus, when a defective package travels in the conveyor 20 and reaches the jam detecting device 10, it will mechanically impact the movable element 12 when passing under the same. In turn, the sensor 13 will be triggered by the movement of the movable element 12 which is recognized by the control unit. The control unit can thereby stop the folding unit 1 before the defective package reaches the output station 22. In this way, the defective packages can be removed before the folding unit 1 is restarted and no defective packages will ever reach the transferring and up-ending unit 100.

It is understood that other variations in the present invention are contemplated and in some instances, some features of the invention can be employed without a corresponding use of other features. Accordingly, it is appropriate that the appended claims be construed broadly in a manner consistent with the scope of the invention.

The invention claimed is:

1. A filling machine for producing packages of pourable food products from sealed packs, the filling machine comprising:

a conveyor configured to move the sealed packs in a first direction;

a folding unit configured to fold at least one end portion of each pack while the conveyor moves the packs to thereby produce the packages; and a transfer unit arranged downstream of the folding unit with respect to the first direction, wherein the conveyor further includes a plurality of plates moved by the conveyor, each plate being configured to receive a respective pack and to deliver a respective produced package to the transfer unit, and wherein the folding unit further includes a jam detecting device for detecting defective packages in the filling machine, the jam detecting device comprising:

a movable element configured to move upon mechanical impact from a defective package;

a shaft arranged in connection with the movable element to ensure a free movement of the movable element; and a sensor connected to the movable element and configured to output a detection signal causing at least a portion of the filling machine to stop operating upon triggering of the sensor, wherein the defective package is constrained by uppermost plates of the conveyor, thereby forcing the defective package to rise above the uppermost plates to cause the mechanical impact from the defective package;

wherein the sensor is triggered by movement of the movable element due to the mechanical impact from the defective package and wherein the detection signal reflects the occurrence of the defective package, wherein the movable element of the jam detecting device is rotationally attached to the shaft and is arranged above the uppermost plates with respect to a vertical direction of the filling machine, and wherein the movable element of the jam detecting device is arranged at a predetermined distance from the uppermost plates to create a clearance between the movable element and any non-defective package passing the moveable element while moved by the conveyor.

2. The filling machine according to claim 1, wherein the jam detecting device is arranged upstream, with respect to the first direction, of an output station of the folding unit.

* * * * *